United States Patent [19]

Coppola et al.

[11] Patent Number: 4,567,914

[45] Date of Patent: Feb. 4, 1986

[54] TWO-STAGE HYDRAULIC SOLENOID VALVE

[75] Inventors: Patrick S. Coppola, Schenectady; John G. Mossey, Waterford, both of N.Y.

[73] Assignee: General Electric Company, Schenectady, N.Y.

[21] Appl. No.: 524,171

[22] Filed: Aug. 17, 1983

Related U.S. Application Data

[63] Continuation-in-part of Ser. No. 289,724, Aug. 3, 1981, abandoned.

[51] Int. Cl.[4] ..... F15B 13/043

[52] U.S. Cl. ..... 137/625.64; 137/625.27; 137/625.65

[58] Field of Search ..... 137/625.6, 625.64, 625.65, 137/625.66, 625.27

[56] References Cited

U.S. PATENT DOCUMENTS

| | | | |
|---|---|---|---|
| 2,852,948 | 9/1958 | Renick | 74/110 |
| 2,912,007 | 11/1959 | Johnson . | |
| 2,913,005 | 11/1959 | Grant | 137/625.6 |
| 2,977,984 | 4/1961 | Barnes | 137/625.64 |
| 2,993,511 | 7/1961 | Johnson | 137/625.64 |
| 2,997,064 | 8/1961 | Gerwig et al. . | |
| 3,126,915 | 3/1964 | Hunt | 137/625.64 X |
| 3,254,675 | 6/1966 | Johnson | 137/625.64 |
| 3,283,784 | 11/1966 | Ruchser | 137/625.64 |
| 3,451,429 | 6/1969 | Vick | 137/625.65 |
| 3,474,828 | 10/1969 | Wheeler et al. | 137/625.6 |
| 3,523,555 | 8/1970 | Padula | 137/625.64 |
| 3,559,686 | 2/1971 | Hoffman | 137/625.64 |
| 3,902,526 | 9/1975 | Brake et al. | 137/625.64 |
| 3,996,965 | 12/1976 | Peters | 137/625.66 |
| 4,050,477 | 9/1977 | Acar | 137/625.64 |
| 4,074,699 | 2/1978 | Stampfli | 137/625.64 |
| 4,150,695 | 4/1979 | Kosugui | 137/625.64 |
| 4,165,762 | 8/1979 | Acar | 137/625.65 X |
| 4,293,002 | 10/1981 | Moriyama et al. | 137/625.6 X |
| 4,347,864 | 9/1982 | Bouteille et al. | 137/625.64 X |

FOREIGN PATENT DOCUMENTS

| | | | |
|---|---|---|---|
| 1500089 | 5/1970 | Fed. Rep. of Germany | 137/625.64 |
| 2108705 | 8/1972 | Fed. Rep. of Germany | 137/625.69 |
| 2536784 | 2/1977 | Fed. Rep. of Germany | 137/625.6 |
| 2701598 | 7/1978 | Fed. Rep. of Germany | 137/625.64 |
| 1240067 | 7/1960 | France | 137/625.27 |
| 1555146 | 11/1979 | United Kingdom . | |

*Primary Examiner*—Gerald A. Michalsky

*Attorney, Agent, or Firm*—Paul Checkovich; John F. Ahern

[57] ABSTRACT

A two-stage hydraulic solenoid valve for controlling the application or release of hydraulic pressure to components of a steam turbine control system. The valve includes a primary hydraulic circuit in which a floating poppet operates between first and second valving positions to connect the valve's outlet port to either an inlet port or a drain port so that the connected control system components receive full hydraulic pressure or are provided with a pressure release path. A secondary hydraulic circuit controls the poppet position through a solenoid actuatable ball and valve seating arrangement wherein a ball is alternatively positioned between a pair of valve seats to switch fluid connections to poppet actuation chambers, one such chamber being located at each end of the poppet. The ball is positioned in sealing contact with one valve seat by the solenoid and is returned to the other seat by fluid pressure upon deactivating the solenoid. A spring is provided to urge the poppet into its first valving position although unbalanced hydraulic forces add to the spring force to firmly seat the valve; the poppet is moved to its second position entirely by unbalanced hydraulic forces.

5 Claims, 2 Drawing Figures

10

10

TWO-STAGE HYDRAULIC SOLENOID VALVE

This is a continuation-in-part of our copending application filed Aug. 3, 1981, Ser. No. 289,724, assigned to the assignee of this application which is abandoned.

BACKGROUND OF THE INVENTION

The present invention relates generally to valves for high pressure hydraulic systems and in particular to fast-acting solenoid valves for use with hydraulically actuated control elements for a steam turbine.

The final control element in a steam turbine control system is generally a plurality of very large, hydraulically positioned valves through which steam flows into the turbine. For example, the steam admission control valves are preferably positioned hydraulically in accordance with a control signal which directs a servo valve to increase or decrease hydraulic pressure on the valve control mechanism. In addition to the normal valve positioning means, it is usual and prudent to also provide auxiliary valving in the hydraulic system so that the steam valves can be very rapidly closed by a trip signal in the event there is loss of load or some similar malfunction which demands a rapid shutoff of the steam flow to the turbine. Rapid closure of the steam valves is carried out in these situations by providing for a quick dump of the hydraulic fluid which sustains the steam valve position. A fast acting solenoid valve is incorporated in the trip system to facilitate the tripping action and is used to initiate the turbine trip in certain instances. It is apparent that the fast acting solenoid valve must perform reliably if the turbine is to be protected in those situations requiring a trip of the steam valves.

In the past, fast acting solenoid valves for performing this particular turbine control function have suffered from a number of drawbacks which have detracted from their reliability. Chief among these are failures to respond to a trip signal because of jammed or stuck parts and failure to pick up under marginally low voltage conditions. In addition, certain fast acting solenoid valves have created pressure transients which are reflected back into the hydraulic system during operation and which have been of sufficient magnitude to disturb other components of the hydraulic system. In general it has also been necessary to protect these valves from the effects of contaminants which might otherwise buildup in the poppet area of the valve.

Furthermore, such sealing of the poppet allows for relatively large clearances, between the poppet and the bore minimizing the chance of jamming due to misalignment or sticking. The surface area exposed to hydraulic pressure at the end of the poppet at the switched actuation chamber end is greater than the corresponding area at the opposing end with the poppet in the normal position, so that, with equal pressure in the chambers, the hydraulic forces are unbalanced and the poppet is held firmly in the first valving position.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
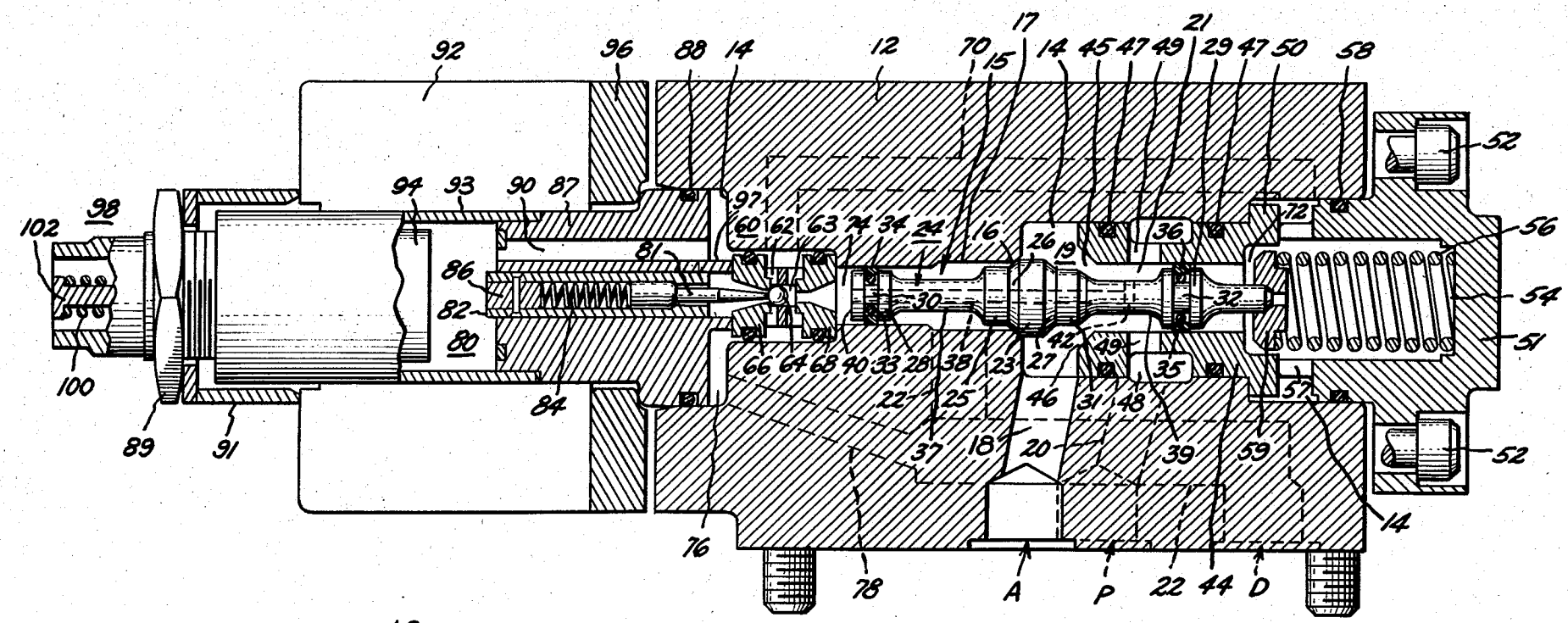
FIG. 1 is a longitudinal sectional view, with a portion shown in cutaway, of a preferred valve embodiment illustrating the valve in its normal or reset position and showing, by dashed lines, fluid passageways interconnecting the various valve ports.
Figure 2:
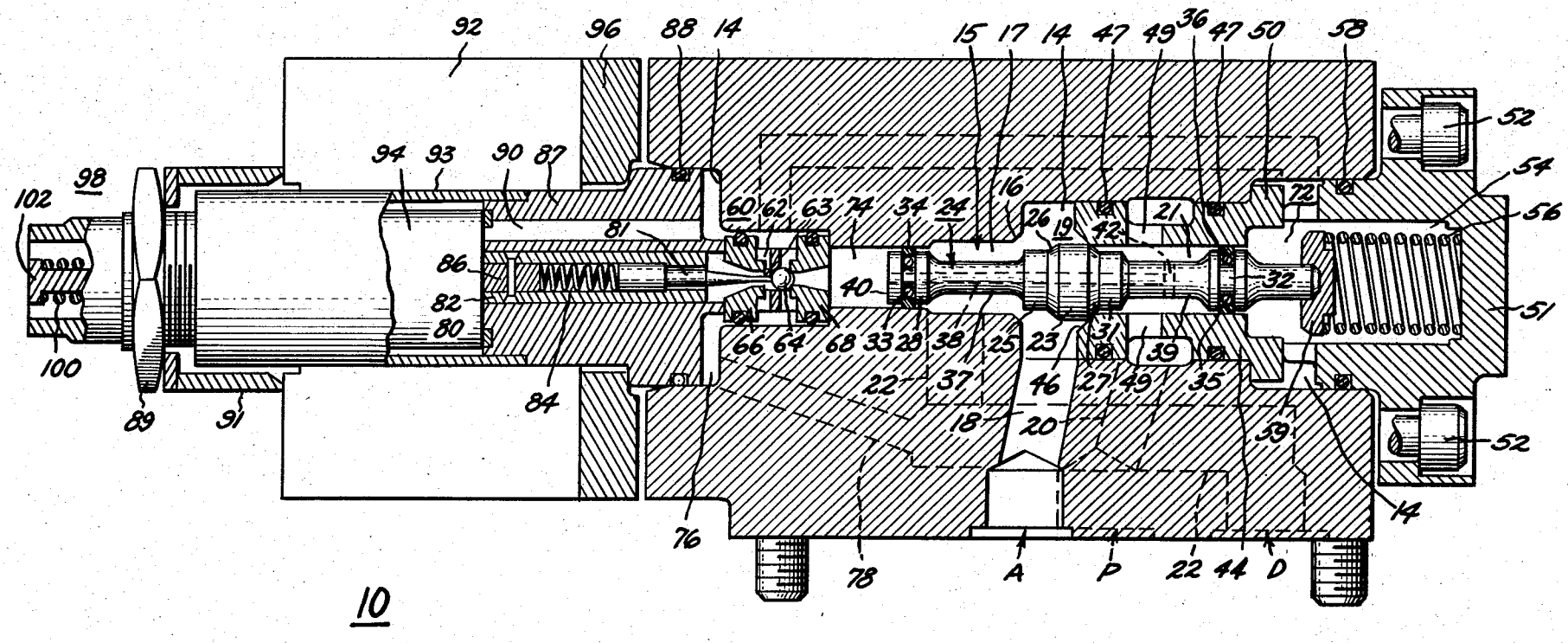
FIG. 2 is a similar view of the valve of FIG. 1 and illustrates the valve in its energized, or trip position.

Referring to the drawing FIGS. 1 and 2, a two-stage hydraulic solenoid valve according to the invention and generally designated at 10 includes a valve body 12 having an inlet, or pressure port, P for making connection to a source of hydraulic fluid under pressure; an outlet port A for making connection to hydraulically controlled mechanism (e.g., a mechanism for positioning a steam valve for a steam turbine); and a drain port D for making connection to a low pressure fluid receiver or return line to the fluid source. Running longitudinally through the valve body 12 is a central opening 14 which is of various diameters at different points along its length and which defines, at one point, an integral, tapered valve seat 16. A common passageway 15 is part of central opening 14, as is cavity 19. A first portion 17 of passageway 15 extends outwardly to the left of cavity 19 and a second portion 21 of passageway 15 extends outwardly to the right of cavity 19 as illustrated in FIG. 1. As shown, cavity 19 is relatively larger than common passageway 15. Valve seat 16 is located at the juncture of portion 17 of the common passageway and cavity 19. Passageways 18, 20, and 22 in the body 12 interconnect the various valve ports A, P, and D, respectively, with the central opening 14 at separate points along its length. It will be convenient at times herein to refer to the interconnection of ports A, P, and D and the central opening 14 as the primary hydraulic circuit.

Disposed within the central opening 14 is an elongated poppet 24 which is freely traversable over short longitudinal distances between first and second valving positions as will hereinafter be more fully described. The poppet 24, shown in FIG. 1 in its normal or reset position and in FIG. 2 in its energized or trip position, is provided with first and second integral, tapered seating surfaces 26 and 27, respectively. The first and second valving positions of the poppet 24 correspond, for example, to the reset and trip conditions of a steam turbine. As illustrated, the poppet has a relatively large midsection 23 which tapers down into seating surfaces 26 and 27 and then into two smaller core sections 25 and 31 on either side of the midsection, and further into two rod sections 37 and 39.

The poppet 24 further includes sealing sections 28 and 29 at opposite ends thereof which are provided with circumferential grooves 30 and 32, respectively. Each groove 30 and 32 is fitted with a pair of seal rings 33 and 34, and 35 and 36, respectively, to prevent hydraulic fluid leakage around the poppet ends. These end seal rings 33, 34, 35, and 36 are more fully described hereinbelow. A fluid passageway 38 through a portion of the poppet 24 opens at one end 40 thereof (herein the second poppet end) and has a traverse portion 42 opening at two sides of the poppet 24 in the vicinity of the passageway 20 to the inlet port P so that fluid communication is maintained between the inlet port P and the second end 40 of the poppet 24 regardless of its position.

Inserted into the central opening 14 at the right end of valve body 12 is a guide and valve seal member 44 which includes a central bore 45 for guiding one end of the poppet and a tapered valve seating surface 46 which mates with the sealing surface 27 as shown in FIG. 2. Central bore 45 is part of portion 21 of the common passageway and seating surface 46 is at the juncture of that portion and cavity 19 as shown in both the Figures. The guide and seal member 44, sealed in the valve body 12 by O-rings 47, is shaped to provide an annular chamber 48 which is in fluid communication with passageway 20 to the inlet port P and, through holes 49 in member 44, with the central opening 14 around a portion of the poppet 24.

The guide and valve seat member 44 is held in place by an integral shoulder 50 mated to the valve body 12 and by an end cap 51 which is pulled up to the valve body by bolts 52. A cavity 54 within the end cap 51 houses a compressed spring 56 which is coupled to the poppet through spring seat 59. Thus, the spring 56 urges the poppet 24 toward its first valving position. The end cap 51 includes an extending portion 57 bearing upon the end of the guide and valve seat member 44 to hold member 44 firmly in place. An O-ring seal 58 prevents leakage of fluid from around the end cap 51. At this point it will be noted that, with the poppet 24 in the reset position as shown in FIG. 1, the inlet port P is in fluid communication with the outlet port A via passageways 18 and 20 and through the open area around valve seat 46. It will also be noted that the drain port D is fluidly isolated from the other two ports by the contact between sealing surfaces 26 and valve seat 16. In the second valving position shown in FIG. 2, the outlet port A is fluidly connected to the drain port D via passageways 18 and 22 and through the open area around valve seat 16. Simultaneously, the inlet port P is fluidly isolated from the other ports by the seal between valve seat 46 and poppet surface 27.

In order to operate the poppet 24 between its first and second valving positions, a second valve stage is provided which comprises a secondary hydraulic circuit and a solenoid actuated valve (the valving portion of which is generally indicated at 60) for directing hydraulic fluid to position the poppet 24.

Valve 60 is housed in an end portion of the central opening 14 of the valve body 12 and includes a slotted disk 62 with a center bore 63 in which a ball 64 is free to move between sealing engagements with oppositely placed third and fourth valve seats 66 and 68, respectively. In the reset position as shown in FIG. 1, a fluid path through the valve 60 is established between the inlet port P (via passageway 38, fourth valve seat 68, and the slots of slotted disk 62) and upper passageway 70. Since the poppet 24 is at least partially actuated by unbalanced hydraulic forces acting at its opposite ends, it will be observed that valve 60, in its reset position, interconnects a first actuation chamber 72 (defined as the hydraulic fluid containment volume at the first end of poppet 24 outward from seal rings 35 and 36), a second actuation chamber 74 (defined as the hydraulic fluid containment volume at the left end of poppet 24 between the poppet end 40 and valve seat 68), and the inlet port P. In the trip position as shown in FIG. 2, ball 64 is moved into contact with valve seat 68 and the first actuation chamber 72 is sealed from the second actuation chamber 74 and inlet port P. However, via third valve seat 66, upper passageway 70, annulus 76, and lower passageway 78, the first actuation chamber is connected to the drain port D. Since drain port D is connected externally to a low pressure receiver, there is a release of hydraulic pressure from the first actuation chamber 72. For clarity in the Figures, certain of the passageways are illustrated schematically; however, it will be apparent to those of ordinary skill in the art how such passageways may practically be provided.

Actuation of the ball valve 60 is carried out by solenoid actuated mechanism 80 fitted into the left end of central opening 14 in valve body 12. The mechanism 80 includes a spring loaded arm 81 which extends outward to contact ball 64. The arm 81 is retained in a sliding housing 82 and is urged outward by breakdown spring 84 which is backed by pinned plug 86. Arm 81 and housing 82 are freely translatable as a unit within mounting block 87 which is provided with seal rings 88 and fluid passageway 90 to permit fluid to enter the solenoid area at the backside of block 87.

Surrounding a portion of the actuation mechanism 80 and extending outward therefrom is a solenoid 92 including a movable armature 94 which is actuated by energizing the solenoid 92. An inner solenoid housing 93 surrounds the armature 94 and is brazed to the block 87 to prevent fluid leakage. Electrical connections to the solenoid 92 are not specifically illustrated in the Figures.

Upon energizing the solenoid 92 the armature 94 is thrust into contact with sliding housing 82 causing arm 81 to drive ball 64 into contact with valve seat 68 (FIG. 2); with the solenoid deenergized, ball 64 is forced into contact with valve seat 66 and returns arm 81 to its deenergized position. The transfer of ball 64 from valve seat 68 to valve seat 66 is caused to occur by fluid pressure acting upon ball 64. The breakdown spring 84 allows the armature 94 to contact mounting block 87 thus preventing burnout in ac solenoids and increasing holding force in both dc and ac coils.

Mounting ring 96, attached to the valve body 12 by bolts (not specifically illustrated), includes integral shoulders to retain the mounting block 87 in place. Mounting block 87, in turn, has an extension portion 97 to hold valve seats 66 and 68 and disk 62 in place. The solenoid 92 is held by retainer 91 backed by nut 89.

Operation

The two stage hydraulic solenoid valve in FIGS. 1 and 2 operates as follows.

Initially, in the reset position, solenoid 92 is deenergized and ball 64 is held in sealing contact with third valve seat 66 by fluid pressure from the second actuation chamber 74 and from the input port P. This allows pressure on the first and second actuation chambers 72 and 74, respectively, to equalize to the pressure applied at inlet port P since the two chambers are connected through ball valve 60 and to the inlet port P through passageway 38. Spring 56 initially forces the poppet 24 into contact with first valve seat 16. Once closed, however, additional force on the poppet 24 is provided by the hydraulic fluid acting on the larger surface area of poppet 24, transverse to its longitudinal axis, at the right end of the poppet 24. That is, when seated, there is an unbalanced hydraulic force on the poppet 24 adding to the force of spring 56. Thus, with the poppet seated on valve seat 16, fluid communication is established to the primary hydraulic circuit between the inlet port P and the outlet port A. Therefore any control system mechanism connected to the outlet port A receives full hydraulic pressure. As illustrated in FIG. 1 when the poppet is in its first valving position, core section 25 is insertable within portion 17 of common passageway 15 thereby establishing a clearance between that core section and the walls of body 12 which define the passageway. Fluid communication is permitted between the outlet port A and inlet port P due to the poppet's smaller rod section 39.

Upon energizing the solenoid 92 (which may, for example, be in response to a turbine trip signal), the armature 94 drives arm 81 forward, causing ball 64 to move into sealing contact with fourth valve seat 68 and releasing the seal at third valve seal 66. The first actuation chamber 72 is thus connected to the drain port D via upper passageway 70, valve 60, annulus 76, and lower passageway 78. With the release in hydraulic pressure from the first actuation chamber 72 there is a very large unbalanced hydraulic force on the poppet 24 to drive it firmly to its second valving position. This force occurs as a result of maintaining fully hydraulic pressure in the second actuation chamber 74 by way of passageway 38 back to inlet port P. Second valve seat 46 is closed and the inlet port P is isolated. The outlet port A, however, is connected to the drain port D through the open valve seat 16 and hydraulic pressure is rapidly released from any control mechanism connected to the outlet port A. As illustrated in FIG. 2 when the poppet is in its second valving position, core section 31 is insertable within portion 21 of common passageway 15 thereby establishing a clearance between that core section and the passageway. Fluid communication between the drain and the outlet port is permitted due to the smaller size of the poppet at rod section 25.

The valve is again reset by deenergizing the solenoid 92 thus allowing valve 60 to be repositioned and causing pressure equalization at both ends of the poppet in the actuation chambers 72 and 74. Spring 56 returns the poppet 24 to the first valving position where it is then held firmly by hydraulic pressure in addition to the force on spring 56.

In order to manually actuate the 2-stage valve 10 (to test the valve or to simulate a turbine trip) a spring-return push button 98 is provided outboard of the solenoid 92 at the left end of the valve 10. A compression spring 100 around center post 102 maintains the push button in its normal position. Upon being manually depressed, the spring 100 is further compressed while center post 102 forces the armature outward into the energized position. Releasing the push button 98 allows the spring 100 to return the push button and armature 94 to their previous positions and the valve 10 to return to the reset position.

Whenever the poppet 24 is caused to shift its valving position, the double seal rings 33 and 34, and 35 and 36 provide a wiping action to clean areas of the opening 14 with which they are in contact. Preferably, the inner rings 33 and 35 are of an elastomeric material and the outer slip rings 34 and 36 are of Teflon composition. This double ring construction aids the wiping and cleaning action to avoid the buildup of contaminants and permits construction without closely fitting parts which minimizes chances of the poppet sticking. In laboratory tests of a valve as disclosed herein, there has been a significant reduction in pressure transients as compared with previously used, commercially available valves. These pressure transients are particularly evident when the fluid from the inlet port is released into the drain port. Such transients may trip other valves hydraulically connected via the inlet port to this particular valve. The longitudinal span of the poppet, as illustrated herein, across midsection 23 and core sections 25 and 31 exceeds both the span of cavity 19 and the span between first and second portions, 17 and 21, respectively, of the common passageway 15. Hence, at least one of the core sections substantially maintains its respective clearance in its corresponding portion of the common passageway irrespective of the poppet's position in the valve or the common passageway. Since a clearance is always maintained in at least one passageway, the poppet core sections 25 and 31 adequately block fluid communication between the inlet and drain ports, even during the transition between its first and second valving positions such that pressure transients in the associated hydraulic system are limited. As is well known in the art, the flow through a bore which has a loosely fitted, solid cylinder inserted in the bore is primarily affected by the cube of the cylinder's radius. Therefore, to limit pressure transients in the associated hydraulic system, one must choose a clearance in the aforementioned valve which will adequately block the flow to the critical elements in the balance of the hydraulic system during the traversal of the poppet across cavity 19. The illustrated valve herein adequately blocks the flow during the poppet's valving action and limits the pressure transients in this fashion.

While there has been shown and described what is considered a preferred embodiment of the invention, it is understood that various other modifications may be made therein. It is intended to claim all such modifications which fall within the true spirit and scope of the present invention.

The invention claimed is:

1. In combination with a high pressure hydraulic control system, a fast acting two-stage hydraulic solenoid valve for rapidly applying or releasing hydraulic pressure on control system components, the valve comprising:

a valve body;

structure within said body defining an inlet port for receiving hydraulic fluid under pressure, an outlet port for interconnecting to said control components, and a drain port for interconnecting to a low pressure reservoir;

a primary hydraulic circuit interconnecting said inlet port, said outlet port, and said drain port through a common passageway within said body said passageway including a central cavity;

first and second valve seats disposed within said primary hydraulic circuit, said first valve seat disposed between said outlet port and said drain port and said second valve seat disposed between said inlet port and said outlet port;

an elongated hydraulically actuable poppet sealingly disposed within said primary hydraulic circuit to define first and second actuation chambers therein respectively at first and second ends of said poppet, said poppet having a longitudinal axis and a passageway for providing fluid communication between said inlet port and said second actuation chamber and said poppet including first and second seating surfaces and being freely traversable in said passageway such that said first seating surface is matable with said first valve seat to sealingly isolate said drain port while maintaining fluid communication between said inlet and outlet ports whenever said poppet is in a first predetermined valving position and said second seating surface is matable with said second valve seat to sealingly isolate said inlet port while maintaining fluid communication between said outlet and drain ports whenever said poppet is in a second predetermined valving position spring means for urging said poppet into said first valving position;

structure within said body further defining a secondary hydraulic circuit interconnecting said drain port, said first actuation chamber, and said second actuation chamber; and a solenoid actuatable control means disposed within said secondary hydraulic circuit and said cavity, said control means including third and fourth valve seats spaced from each other and disposed in face to face relationship with each other and a ball disposed between said third and fourth valve seats, said ball translatable such that in a first predetermined control position the ball is in sealing engagement with said third valve seat for prohibiting fluid flow communicating between said drain port and both said first and second actuation chambers, and in a second predetermined control position the ball is in sealing engagement with said fourth valve seat for prohibiting fluid flow communication between said second actuation chamber and both said first actuation chamber and said drain port, said first and second control positions respectively corresponding to the first and second valving positions, respectively.

2. The valve as in claim 1 further including a spring loaded arm having one end in proximity to said ball and a solenoid including an armature for driving said arm to force said ball to said second position whenever said solenoid is energized.

3. The valve as in claim 2 wherein the surface area of said poppet transverse to the longitudinal axis thereof and exposed to hydraulic pressure is greater at said first poppet end then at said second poppet end.

4. The valve as in claim 2 further including means for manual actuation of said valve affixed to said valve body and having a connecting member for driving said spring loaded arm to force said ball to said second position during manual actuation.

5. The valve as in claim 1 wherein said poppet is sealingly disposed within said primary hydraulic circuit by a first ring seal near said first poppet end and by a second ring seal near said second poppet end, each said ring seal comprising an inner seal ring and an outer slipper ring, said inner and outer rings being of different materials of construction.

* * * * *